United States Patent [19]

Gerber

[11] Patent Number: 4,561,127

[45] Date of Patent: Dec. 31, 1985

[54] MAKING OF GARMENT BY SINGLE PLY CUTTING FOLLOWED BY SUCCESSIVE SEWING STAGES

[75] Inventor: Heinz J. Gerber, West Hartford, Conn.

[73] Assignee: Gerber Scientific Inc., South Windsor, Conn.

[21] Appl. No.: 436,703

[22] Filed: Oct. 25, 1982

[51] Int. Cl.[4] ..... A41D 27/00

[52] U.S. Cl. ..... 2/243 R; 112/262.1

[58] Field of Search ..... 2/243 R; 112/262.1, 112/262.3, 121.11

[56] References Cited

U.S. PATENT DOCUMENTS

| | | | |
|---|---|---|---|
| 3,621,801 | 11/1971 | Huddleston | 112/262.3 |
| 4,338,672 | 7/1982 | Perzley | 364/478 |
| 4,373,412 | 2/1983 | Gerber | 83/24 |

*Primary Examiner*—Ronald Feldbaum

*Attorney, Agent, or Firm*—McCormick, Paulding & Huber

[57] ABSTRACT

Single sheets of garment material are spread on work tables for cutting by a computer controlled cutter to provide all pattern pieces for assembly into a particular garment. The pieces are selectively picked up for transport in pairs to first stage sewing stations where they are joined to provide subassembled garment pieces. Robotic devices are used for this transfer and/or joining steps and the process is repeated successively until a finished garment is produced.

2 Claims, 2 Drawing Figures

MAKING OF GARMENT BY SINGLE PLY CUTTING FOLLOWED BY SUCCESSIVE SEWING STAGES

BACKGROUND OF THE INVENTION

Present technology in the garment industry incorporates state of the art automation and computerization in several discrete areas. For example, major developments have been achieved in computerized cloth cutting with multi-ply layups provided on work tables where stacks of pattern pieces can be cut by a reciprocating cutter capable of programmed movement through the layup to provide stacks of similarly shaped garments pieces. These stacks are marked and graded for subsequent sorting so as to be transferred to sewing stations where suitably shaped pieces are put together to make a garment. Automatic sewing machines may reduce the manual labor and skill required to produce each such garment, but the necessity for a skilled tradesman to assemble the various pieces for sewing etc. is implicit in the present process. Further, the sorting process is still very labor intensive due to the necessity of providing the proper type and number of pieces at such a single sewing station, which station is necessarily the province of a highly skilled tradesman.

SUMMARY OF THE INVENTION

This invention relates to a significant modification of the above described wherein the technology of today is still utilized to cut the pieces which will ultimately be combined to produce the garment, but instead of relying upon a skilled tradesman to operate an automatic, or semi-automatic sewing machine, several less skilled workers, or several sophisticated robotic devices with simple sewing machines, can be employed to produce subassemblies at successive stations in an extended production line where the garment does not take final shape until the subassemblies have been assembled to ultimately produce a finished garment at a final work station.

The chief aim of the present invention then is to eliminate the labor intensive sorting of pattern piece bundles and bundle breakdown and collating of such pieces, and also to reduce the degree of skill required at the heretofore critical garment creation station.

DETAILED DESCRIPTION

Figure 1:
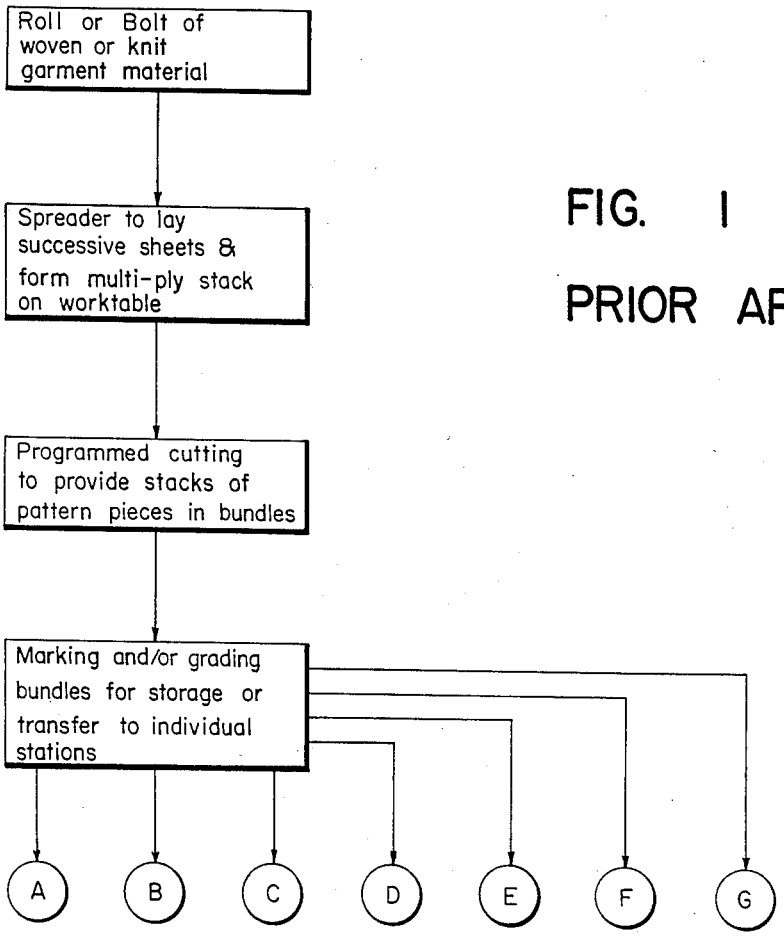
FIG. 1 PRIOR ART
FIG. 1 is a schematic view of the prior art garment technology process utilizing precut and premarked bundles of pattern pieces and state of the art sewing machines.
Figure 2:
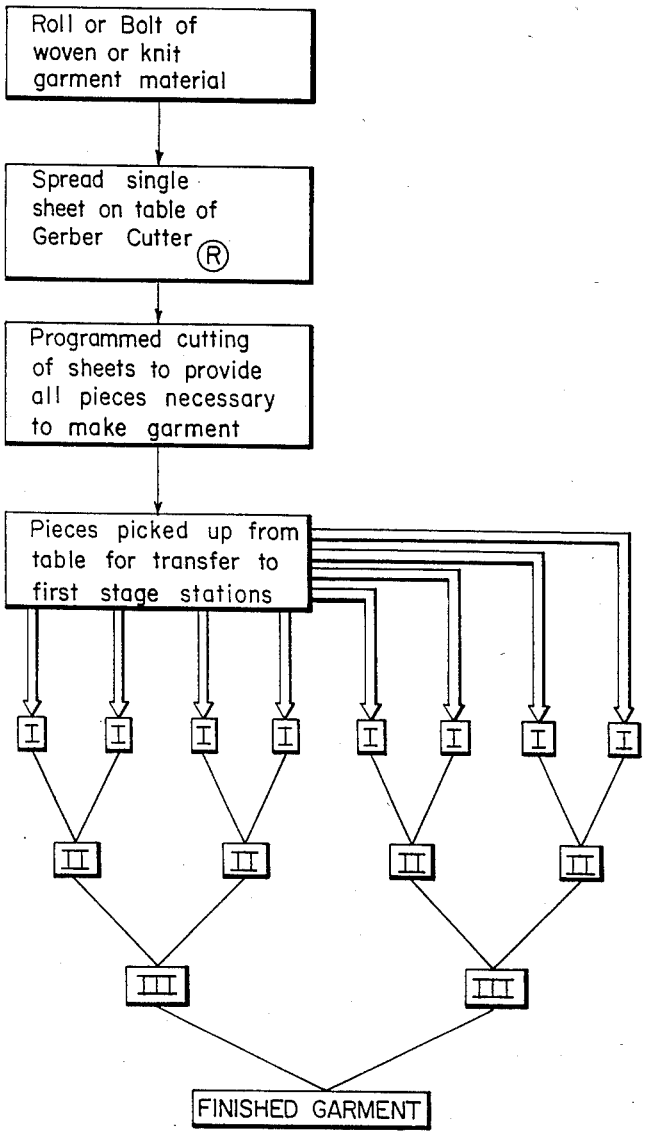
FIG. 2 is a schematic view of a streamlined production process wherein the need for sorting bundles is eliminated and wherein successive sewing stations reduce or eliminate the labor required to produce a finished garment.

As mentioned previously the process illustrated schematically in FIG. 2 has for its purpose the elimination of the present day labor intensive sorting and transporting of the bundles of pattern pieces which are being produced on state of the art cutting machines. FIG. 2 shows that this is accomplished by spreading a single sheet of material on the work table and cutting it up into the various pattern pieces required for a particular garment. These pieces, individually quite unique in size or shape as dictated by the design characteristics of the garment itself, are picked up, in pairs preferably, for transport to a series of first stage stations where the pieces are joined by sewing or other fastening means. This step may be accomplished by a semi-skilled seamstress on a conventional sewing machine or by an automated sewing machine operating in conjunction with a robotic arm type transfer device capable of mating the paired pattern pieces in a programmed mode.

Several such first stage sewing or joining stations are provided for mating preselected groups of pattern pieces and as few as two such pieces may be joined at these first stage stations to provide garment subassemblies.

In accordance with the present invention these subassemblies are picked-up by hand, or by robotic devices, for transfer to second stage stations where they are grouped for joining to provide assemblies comprising at least two such subassemblies each. In the series of successive assembly stages the grouping is always carried out to merge the processing lines from two different stations in the preceding stage into one new processing line and to reduce the number of processing lines in a geometric progression until finally a completed garment is formed.

This process is continued until a complete garment is produced by this series of successive assembly steps wherein each individual mating and joining operation is divided up so as to be well suited to automation by state of the art robotic devices. The disclosure of U.S. Pat. No. 4,338,672 issued July 6, 1982 to Unimation, Inc. of Danbury, Conn. is incorporated by reference to show the state of the art for such devices.

As there described in considerable detail such devices can be "taught" to follow precomputed paths for "playback" in a work cycle or mode to accomplish the transfer steps described in the subject application and to hold the paired pattern pieces for sewing, or joining, at each of the successive stations in the progression which leads ultimately to the finished garment. Although this prior art patent shows a welding head on the manipulator arm it will be apparent that a pick-up head for the pattern pieces can be substituted therefor. Furthermore, if the pattern pieces or subassemblies of pattern pieces are properly held in some sort of fixture at the various stations it would be feasible to provide a robotic arm mounted sewing or joining head thereon to completely eliminate the necessity for human intervention carrying out the process suggested in FIG. 2.

Finally, applicant also requests that the disclosure in a pending application (Ser. No. 168,312 filed July 10, 1980) also be incorporated by reference herein. This application is allowed and will issue shortly to myself and David R. Pearl. It is entitled "Method For Cutting Sheet Material With a Cutting Wheel" and discloses a very efficient system for cutting a single ply or layer of sheet material under the control of a computer which is programmed to cut out the various pieces required in the manufacture of a garment pursuant to the present invention.

I claim:

1. A process for the manufacture of garments from pattern pieces comprising the steps of:

(a) spreading material on the work table of a cutting machine capable of programmed cutting under the control of a computer, (b) cutting the material while it is on the table to provide pattern pieces of predetermined size and shape as dictated by the design characteristics of a particular garment, (c) picking up the pattern pieces in preselected groups for transfer to first stage stations where these groups can be mated, (d) joining the pieces in several such first stage stations to provide subassemblies comprising at least two joined pattern pieces, (e) picking up the subassemblies and grouping certain of them for mating at second stage stations, (f) joining said certain subassemblies at said second stage stations to provide assemblies comprising at least two joined subassemblies, (g) continuing with the steps of joining, picking and grouping at successive stages, the step of grouping at the second and subsequent stages always being carried out to merge two processing lines from the preceding stage into one new processing line and to reduce the number of processing lines through the successive stages in a geometric progression until a complete garment is formed.

2. The process according to claim 1 wherein the cutting step is accomplished on a single sheet of material so spread on the work table, and wherein said pattern piece pick-up step is accomplished prior to spreading a succeeding sheet of material.

* * * * *